US005737899A

United States Patent [19]

Supron et al.

[11] Patent Number: 5,737,899

[45] Date of Patent: Apr. 14, 1998

[54] INSERTION PACKET CENTERING DEVICE

[75] Inventors: Steven A. Supron, Prospect; Michael D. Ballard, Sandy Hook; Joseph H. Marzullo, Brookfield, all of Conn.

[73] Assignee: Pitney Bowes Inc., Stamford, Conn.

[21] Appl. No.: 687,308

[22] Filed: Jul. 26, 1996

[51] Int. Cl.[6] ..... B65B 35/54

[52] U.S. Cl. ..... 53/155; 53/238; 53/257; 53/284.3; 53/381.5; 53/540; 53/569

[58] Field of Search ..... 53/154, 155, 237, 53/238, 247, 257, 284.3, 381.5, 381.6, 381.7, 495, 506, 540, 569

[56] References Cited

U.S. PATENT DOCUMENTS

| | | | |
|---|---|---|---|
| 2,728,178 | 12/1955 | Kern | 53/284.3 |
| 2,914,895 | 12/1959 | Martin | 53/569 X |
| 3,253,384 | 5/1966 | Huck et al. | 53/284.3 X |
| 4,418,515 | 12/1983 | Foster et al. | 53/284.3 X |
| 4,712,359 | 12/1987 | DePasquale et al. | 53/284.3 X |
| 4,903,461 | 2/1990 | Dimur | 53/284.3 X |
| 5,152,122 | 10/1992 | DeBarber et al. | 53/284.3 X |
| 5,168,689 | 12/1992 | Macelis | 53/284.3 X |

*Primary Examiner*—Daniel Moon

*Attorney, Agent, or Firm*—Ronald Reichman; Melvin J. Scolnick; Robert Meyer

[57] ABSTRACT

This invention provides utilizes a centering device located in the accumulation portion of mail production equipment to reduce jamming caused by the insertion of material into an open envelope. The apparatus of this invention is located in the accumulation area of production mail equipment before the inserter. The apparatus of this invention includes: two guides; a solenoid and a flexible wire cable. Two centering guides are actuated through a solenoid and move to a predetermined center position to align and deskew the accumulated enclosure contents (which may include printed and pre-printed folded sheets, business reply envelopes and other insert material). A flexible wire cable is used to provide highly efficient transfer of motion from the solenoid to the centering guides.

8 Claims, 2 Drawing Sheets

INSERTION PACKET CENTERING DEVICE

FIELD OF THE INVENTION

The invention relates generally to the field of preparing mail pieces and more particularly to inserting a mail piece in an envelope.

BACKGROUND OF THE INVENTION

In mail production equipment, various activities take place for the purpose of producing mail pieces. Such activities include the selection of inserts, the collection and stacking of the selected inserts, the placing of the inserts into an envelope and the sealing of the envelope to form the mail piece. In order for the inserts to be stuffed into an envelope, the mouth of the envelope may be opened so as to be able to receive the inserts.

Devices that have been used previously included fingers or a claw assembly, that were located in the accumulation area of production mail equipment. The claw assembly opened the mouth of the envelope while the envelope was held stationary and material was inserted into the envelope. After insertion is complete, the fingers or claw assembly is removed from the mouth of the envelope and the stuffed envelope is carried away in an appropriate manner.

Although such devices worked well with production mail equipment, problems developed as the path of the inserted material and the path of the envelope increased in distance. The increased travel distance, increased the amount of misalignment between the envelope and inserted material.

When, the claw assembly opened an envelope for insertion of materials, the claw assembly would round the edges of the envelope and shorten the throat of the envelope. Thus, as the envelope is opened the length of the throat is effectively shortened. Often, the dimensions of the inserted material was just a little bit smaller than the dimensions of the open envelope. For instance, if a number 9 envelope, measuring 4"×8⅞" was part of the material that was going to be inserted into a number 10 envelope, measuring 4"×9½", there would only be approximately ¼" clearance on each length side of the envelope. When the throat of the envelope was opened the clearance would be reduced to approximately 3/16". Thus, if the inserted material was not accurately aligned to within ⅛" with the opened throat of the envelope, the material to be inserted into the envelope would impact on the envelope side and not be inserted into the envelope and the production mail equipment would jam.

The prior art attempted to overcome the aforementioned jamming problem by accurately aligning the position of the claw assembly relative to the position of the opened envelope and material to be inserted. The aligning adjustment was time consuming and required a trained equipment operator. Another disadvantage of the prior art was that the adjustment had to be redone if different size envelopes or different size stock was used.

SUMMARY OF THE INVENTION

This invention overcomes the disadvantages of the prior art by providing a centering device located in the accumulation portion of mail production equipment, that reduces jamming caused by the insertion of material into an open envelope. The apparatus of this invention does not require adjustment, when the size of the open envelope and material to be inserted is changed. No adjustment is also required if the type of envelope and type of inserted material is changed.

The apparatus of this invention is located in the accumulation area of production mail equipment before the inserter. The apparatus of this invention includes: two guides; a solenoid and a flexible wire cable. Two centering guides are actuated through a solenoid and move to a predetermined center position to align and deskew the accumulated enclosure contents (which may include printed and pre-printed folded sheets, business reply envelopes and other insert material). A flexible wire cable is used to provide highly efficient transfer of motion from the solenoid to the centering guides.

DETAILED DESCRIPTION OF THE PREFERRED EMBODIMENT

Figure 1:
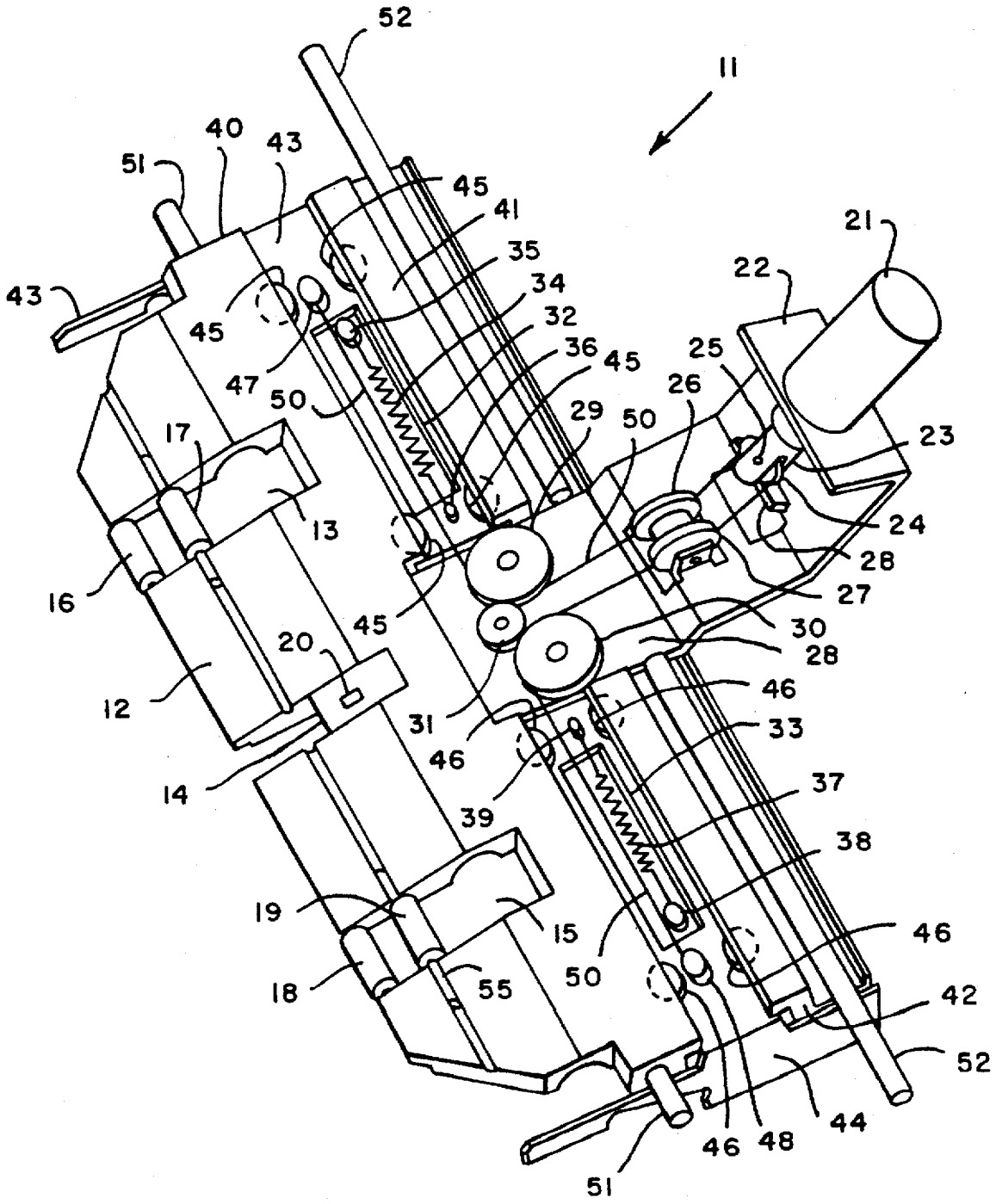
FIG. 1 is a perspective drawing of the apparatus of this invention.

Referring now to the drawings in detail, and more particularly to FIG. 1 the reference character 11 represents the insertion packet centering device of this invention. Pockets 13, 14 and 15 are formed within device 12. Upper insertion nip roller 16 and lower envelope positioner roller 17 are located within pocket 13. Upper insertion nip roller 18 and lower envelope positioner roller 19 are located within pocket 15. A presence sensor 20 is located within pocket 14.

A solenoid 21 is connected to assembly 22. Solenoid 21 has an actuator 23. A cable pulley 24 is connected to actuator 23 by pin 25. Cable pulleys 26 and 27 and mechanical stop 28 are connected to assembly 22. Pocket 28 is formed within device 11. Cable pulleys 29 and 30 as well as idler pulley 31 are located within pocket 28. Pockets 32 and 33 are formed within device 11. A spring 34 is located within pocket 32. One end of spring 34 is connected to spring ground connection 35 and the other end of spring 34 is connected to connector 36. A spring 37 is located within pocket 33. One end of spring 37 is connected to spring ground connection 38 and the other end of spring 37 is connected to connector 39. Mechanical stops 40 and 42 and platform 41 are part of base 12. Centering guide 43 is connected to the left side of pocket 28 and centering guide 44 is connected to the right side of pocket 28. Sliders 45 are connected to centering guide 43 and sliders 46 are connected to centering guide 44.

Cable 50 connects centering guides 43 and 44 to actuator 23 of solenoid 21. One end of cable 50 is threaded around cable pulleys 24, 26 and 29 and connected to cable attachment 47. The other end of cable 50 is threaded around cable pulleys 24, 27 and 30 and connected to cable attachment 48, before idler pulley 31 secures cable 50 to cable pulleys 29 and 30. Springs 34 and 37 respectively hold centering guides 43 and 44 in an open position and assist in the opening of solenoid 21. When solenoid 21 is activated, actuator 23 causes centering guides 43 and 44 to move closer to each other until they are stopped by mechanical stops 40 and 42. Actuator 23 is located at mechanical stop 28 when solenoid 21 is not energized and actuator 23 moves towards solenoid 21 when solenoid 21 is energized. Sliders 45 are held away from each other by spring 34 and sliders 46 are held away from each other by spring 37.

Assembly supports 51 and 52 are attached to base 12. Supports 51 and 52 are used to attach device 12 to mail production equipment.

Figure 2:
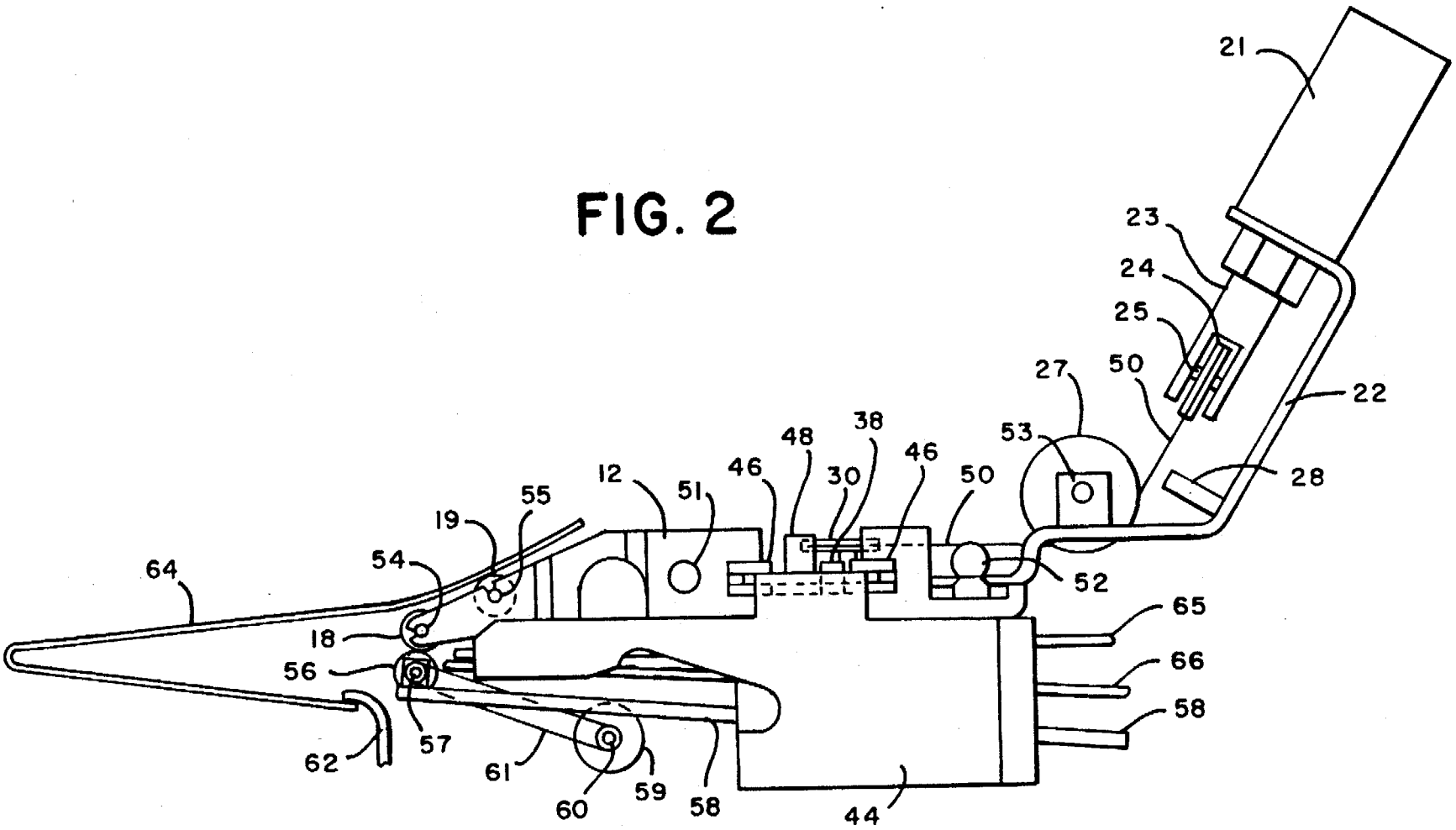
FIG. 2 is a drawing of a side view along direction E—E of FIG. 1.

FIG. 2 is a drawing of a side view along direction E—E of FIG. 1. Solenoid 21 and actuator 23 are connected to assembly 22. Cable pulley 24 is connected to actuator 23 by pin 25. Stop 28 is also attached to assembly 22. Cable 50 is on cable pulley 27 and cable pulley 27. Centering guide 44 is connected to assembly 28 and base 12. Assembly support 50 is attached to base 12. Upper insertion nip roller 18 is rotating about pin 54 and envelope positioner roller 19 is rotating about pin 55. Lower insertion roller 56 rotates about pin 57 and is supported by support deck 58. Lower pre insertion drive roller 59 rotates about pin 60 and is supported about support deck 58. A belt 61 is connected between rollers 56 and 59. A claw 62 attached to a base (not shown). Enclosures that consist of packets of printed, preprinted folded sheets, other insert material and/or envelopes are stacked on platform 65. Other enclosures that may or may not differ in size from the enclosures stacked on platform 65, consist of packets of printed, preprinted folded sheets, other insert material and/or envelopes are stacked on platform 66. Claw 62 is opening envelope 64 so that enclosures or packets stacked on platforms 65 and 66 may be inserted into envelope 64 without jamming.

Centering guide 44 and centering guide 43 (FIG. 1) move to their centering position by the force exerted by solenoid 21. The aforementioned centering position is a predetermined position that will align and deskew the accumulated enclosure packets that are fed from platforms 65 and 66. During the movement of guides 43 and 44, guides 43 and 44 shift any movement of the enclosures that are fed from platforms 65 and 66 to the path guides 43 and 44 take. When guides 43 and 44 are in a closed position, i.e., closer to each other, nip rollers 16 and 18 may be reengaged to lock the packets from platforms 65 and 66 into an aligned position. Thus, lower insertion drive roller 59 and lower insertion nip roller 56 may reliably transport the packets that are being fed from platforms 65 and 66 into envelope 64, when claw 62 opens envelope 64. When solenoid 21 is deenergized guides 43 and 44, springs 34 and 37 would respectively return guides 43 to their original position, i.e., when they are farthest away from each other.

The above specification describes a new and improved insertion device that aligns enclosures that may be of different sizes to a targeted position prior to be inserted into an open envelope. It is realized that the above description may indicate to those skilled in the art additional ways in which the principles of this invention may be used without departing from the spirit. It is, therefore, intended that this invention be limited only by the scope of the appended claims.

What is claimed is:

1. An alignment centering device for aligning a first packet, that is moved from a first platform to an accumulation area, with a second packet, that may differ in size, from the first packet, the second packet is moved from a second platform to an accumulation area, said device comprises:

a pair of lateral centering guides;

a solenoid;

a flexible cable connected to said solenoid and to said lateral centering guides to provide efficient transfer of motion from the solenoid to said centering guides so that when said solenoid is energized said centering guides move from a first predetermined position to a second predetermined position to align said first and second packet, and when said solenoid is de-energized said centering guides move from the second position to the first position;

means for opening the throat of an envelope; and means for inserting said first and second aligned packet into said open envelope.

2. The alignment device claimed in claim 1, further including a pulley system; and said cable is wound around said pulley system.

3. The alignment device claimed in claim 2, further including:

one or more pair of springs that are coupled to said cable and said centering guides to dampen the motion of said centering guides.

4. The alignment device claimed in claim 1, further including: one or more stops that restrict the movement of said centering guides.

5. The alignment device claimed in claim 1, wherein said means for opening is a claw.

6. The alignment device claimed in claim 1, wherein said means for inserting is a pair of rollers.

7. The alignment device claimed in claim 1, further including means for sensing the presence of an envelope in the accumulation area.

8. The alignment device claimed in claim 1, further including means for sensing the presence of the first and second packet in the accumulator area.

* * * * *